US008412083B2

(12) United States Patent
Fujiwara et al.

(10) Patent No.: US 8,412,083 B2
(45) Date of Patent: Apr. 2, 2013

(54) FIXING DEVICE

(75) Inventors: Yasushi Fujiwara, Itami (JP); Tsuneo Fujiwara, legal representative, Itami (JP); Etsuko Fujiwara, legal representative, Itami (JP); Kei Ishida, Nagoya (JP); Noboru Suzuki, Komaki (JP); Takuji Matsuno, Ichinomiya (JP); Tomohiro Kondo, Nagoya (JP); Yoshihiro Miyauchi, Ama (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 7 days.

(21) Appl. No.: 12/915,269

(22) Filed: Oct. 29, 2010

(65) Prior Publication Data

US 2011/0158718 A1 Jun. 30, 2011

(30) Foreign Application Priority Data

Oct. 30, 2009 (JP) ..... 2009-250056
Oct. 30, 2009 (JP) ..... 2009-250062

(51) Int. Cl.
*G03G 15/20* (2006.01)

(52) U.S. Cl. ..... 399/329

(58) Field of Classification Search ..... 399/329
See application file for complete search history.

(56) References Cited

U.S. PATENT DOCUMENTS 6,979,107 B1 * 12/2005 Benensohn ..... 362/374
7,076,198 B2 * 7/2006 Kim et al. ..... 399/330
7,623,817 B2 * 11/2009 Jung et al. ..... 399/328
7,792,476 B2 * 9/2010 Seol et al. ..... 399/329
7,805,102 B2 9/2010 Kato
7,881,650 B2 * 2/2011 Shin et al. ..... 399/329
2004/0062578 A1 4/2004 Kim et al.
2008/0187372 A1 8/2008 Kato
2008/0317527 A1 12/2008 Seol et al.

(Continued)

FOREIGN PATENT DOCUMENTS

CN 101221400 A 7/2008
JP 08-146796 A 6/1996

(Continued)

OTHER PUBLICATIONS

European Search Report for corresponding European Patent Application No. 10 013 602.7 DTD. Jun. 18, 2012.

(Continued)

*Primary Examiner* — David Gray
*Assistant Examiner* — Sevan A Aydin
(74) *Attorney, Agent, or Firm* — Banner & Witcoff, Ltd.

(57) ABSTRACT

A fixing device for thermally fixing a developer image transferred onto a recording sheet, includes: a flexible fusing member which is flexibly deformable; a heating element; a nip member disposed in such a manner as to contact with a surface of the flexible fusing member and to allow the flexible fusing member to slide along the nip member; a reflecting plate configured to reflect radiant heat from the heating element in a direction toward the nip member; a backup member configured to nip the flexible fusing member with the nip member to thereby form a nip portion for the recording sheet between the flexible fusing member and the backup member; and a stay configured to support both end portions of the nip member. The reflecting plate has at least one flange portion, and the flange portion is held and supported between the nip member and the stay.

13 Claims, 7 Drawing Sheets

U.S. PATENT DOCUMENTS

| | | | |
|---|---|---|---|
| 2009/0092423 | A1 | 4/2009 | Shin et al. |
| 2009/0208264 | A1 | 8/2009 | Fujiwara et al. |

FOREIGN PATENT DOCUMENTS

| | | | |
|---|---|---|---|
| JP | 08-248791 | A | 9/1996 |
| JP | 2004-054072 | A | 2/2004 |
| JP | 2007-057851 | A | 3/2007 |
| JP | 2008-139666 | | 6/2008 |
| JP | 2008-233886 | | 10/2008 |
| JP | 2008-257946 | | 10/2008 |

OTHER PUBLICATIONS

Office Action for corresponding Chinese Patent Application No. 201010535973.7 DTD. Jun. 28, 2012.

* cited by examiner

FIXING DEVICE

CROSS-REFERENCE TO RELATED APPLICATIONS

This application claims priority from Japanese Patent Application Nos. 2009-250056 and 2009-250062, both filed on Oct. 30, 2009, the disclosures of which are incorporated herein by reference in their entirety.

TECHNICAL FIELD

The present invention relates to a fixing device for thermally fixing a developer image transferred onto a recording sheet.

BACKGROUND ART

A fixing device for use in an electrophotographic image forming apparatus is known in the art, which includes a fusing film, a heater, a nip plate as a heating plate for forming a nip portion between a pressure roller and the nip plate through the fusing film, a reflecting plate for reflecting radiant heat from the heater toward the nip plate, and a holding member for holding the heater, the nip plate and the reflecting plate.

However, in terms of utilizing radiant heat from the heater and effectively performing fixing, there is still room for improvement on the conventional fixing device.

SUMMARY OF THE INVENTION

According to a first aspect of the present invention, there is provided a fixing device for thermally fixing a developer image transferred onto a recording sheet, comprising: a tubular fusing film; a heating element disposed inside the fusing film; a nip plate disposed in such a manner as to contact with an inner surface of the fusing film and to allow the fusing film to slide along the nip plate; a reflecting plate configured to reflect radiant heat from the heating element in a direction toward the nip plate; a backup member configured to nip the fusing film with the nip plate to thereby form a nip portion for the recording sheet between the fusing film and the backup member; and a stay configured to support both end portions of the nip plate located in positions upstream and downstream, respectively, with respect to a recording sheet conveyance direction, wherein the reflecting plate has a flange portion extending along the recording sheet conveyance direction, and the flange portion is held and supported between the nip plate and the stay.

According to a second aspect of the present invention, there is provided a fixing device for thermally fixing a developer image transferred onto a recording sheet, comprising: a flexible fusing member which is flexibly deformable; a heating element; a nip member disposed in such a manner as to contact with a surface of the flexible fusing member and to allow the flexible fusing member to slide along the nip member; a reflecting plate configured to reflect radiant heat from the heating element in a direction toward the nip member; a backup member configured to nip the flexible fusing member with the nip member to thereby form a nip portion for the recording sheet between the flexible fusing member and the backup member; and a stay configured to support both end portions of the nip member, wherein the reflecting plate has at least one flange portion, and the flange portion is held and supported between the nip member and the stay.

According to a third aspect of the present invention, there is provided a fixing device for thermally fixing a developer image transferred onto a recording sheet, comprising: a tubular fusing film; a heating element disposed inside the fusing film; a nip plate disposed in such a manner as to contact with an inner surface of the fusing film and to allow the fusing film to slide along the nip plate; a reflecting plate configured to reflect radiant heat from the heating element in a direction toward the nip plate; a backup member configured to nip the fusing film with the nip plate to thereby form a nip portion for the recording sheet between the fusing film and the backup member; and a stay configured to support the nip plate and having a shape to follow a contour of the reflecting plate and disposed to surround the reflecting plate, wherein a thin layer of space is interposed between the reflecting plate and the stay.

BRIEF DESCRIPTION OF THE DRAWINGS

To better understand the claimed invention, and to show how the same may be carried into effect, reference will now be made, by way of example only, to the accompanying drawings, in which:

DESCRIPTION OF EMBODIMENTS

A detailed description will be given of illustrative embodiments of the present invention with reference to the drawings. In the following description, a general arrangement of a laser printer 1 (image forming apparatus) provided with a fixing device 100 according to one embodiment of the present invention will be described, and thereafter features of the fixing device 100 will be described in detail.

<General Arrangement of Laser Printer>

Figure 1:
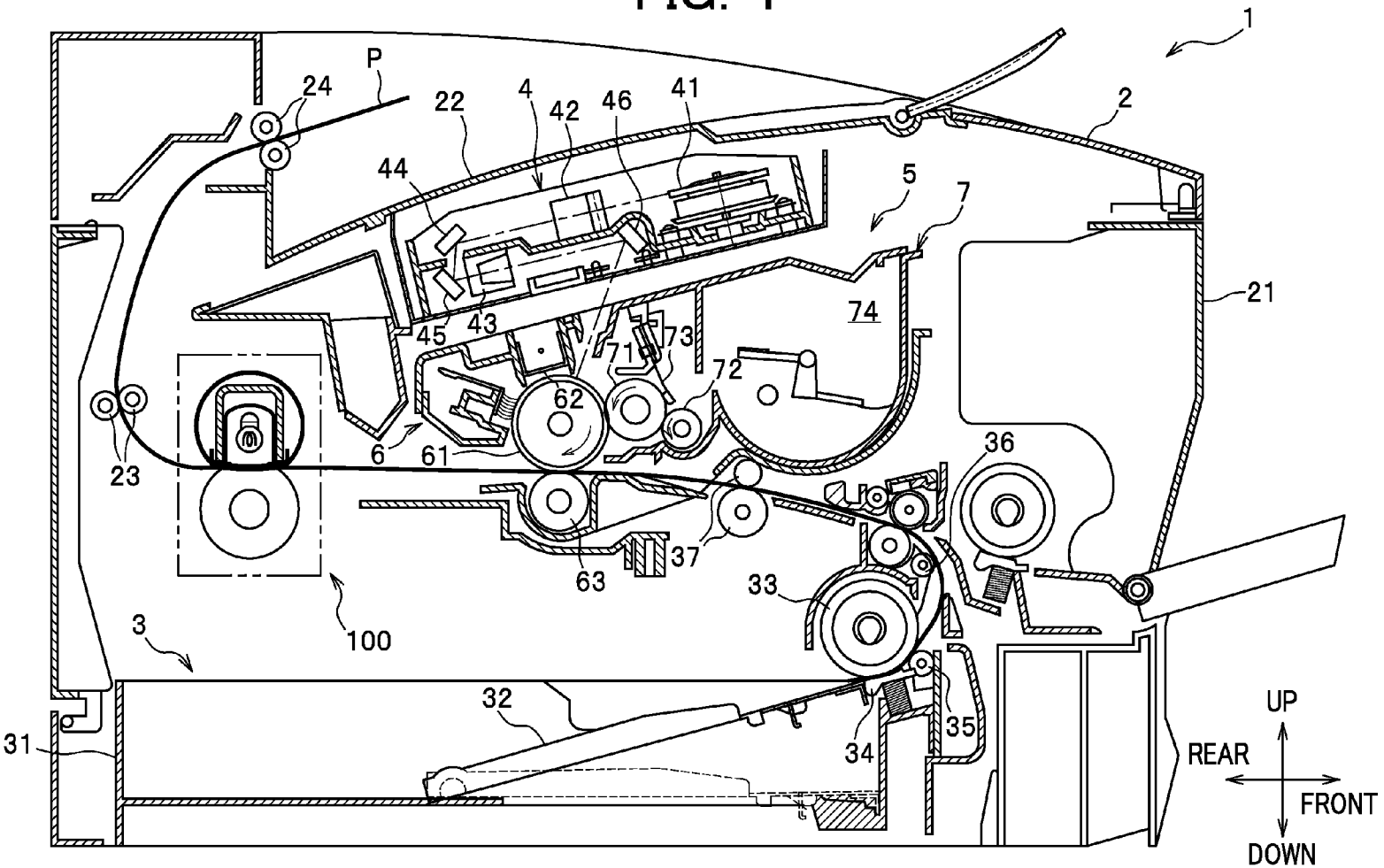
FIG. 1 is a schematic diagram of a laser printer provided with a fixing device according to an exemplary embodiment of the present invention.

As shown in FIG. 1, a laser printer 1 comprises a body casing 2, and several components housed within the body casing 2 which principally include a sheet feeder unit 3 for feeding a sheet P (e.g., of paper) as one example of a recording sheet, an exposure device 4, a process cartridge 5 for transferring a toner image (developer image) onto the sheet P, and a fixing device 100 for thermally fixing the toner image transferred onto the sheet P.

Hereinbelow, in describing the arrangement and operation of each component in the laser printer 1, the direction is designated as from the viewpoint of a user who is using (operating) the laser printer 1. To be more specific, in FIG. 1, the right-hand side of the drawing sheet corresponds to the "front" side of the printer, the left-hand side of the drawing sheet corresponds to the "rear" side of the printer, the front side of the drawing sheet corresponds to the "left" side of the printer, and the back side of the drawing sheet corresponds to the "right" side of the printer. Similarly, the direction extending from top to bottom of the drawing sheet corresponds to the "vertical" or "up/down (upper/lower or top/bottom)" direction of the printer.

The sheet feeder unit 3, provided in a lower space within the body casing 2, principally includes a sheet feed tray 31 for storing sheets P, a sheet pressure plate 32 for pushing up front sides of the sheets P, a sheet feed roller 33, a sheet feed pad 34, paper powder remover rollers 35, 36, and registration rollers 37. Sheets P in the sheet feed tray 31 are pressed against the sheet feed roller 33 by the sheet pressure plate 32, and each sheet P, separated from the others by the sheet feed roller 33 and the sheet feed pad 34, is conveyed through the paper powder remover rollers 35, 36 and the registration roller 37 into the process cartridge 5.

The exposure device 4 is provided in an upper space within the body casing 2, and principally includes a laser beam emitter (not shown), a polygon mirror 41 configured to be driven to spin, lenses 42, 43, and reflecting mirrors 44, 45, 46. The exposure device 4 is configured to cause a laser beam produced based upon image data to travel along a path indicated by alternate long and short dashed lines, by reflecting or transmitting the same at the polygon mirror 41, the lens 42, the reflecting mirrors 44, 45, the lens 43, and the reflecting mirror 46 in this order, so that a peripheral surface of a photoconductor drum 61 is rapidly scanned and illuminated consecutively with the laser beam.

The process cartridge 5 is disposed below the exposure device 4 within the body casing 2, and configured to be installable in and removable from the body casing 2 through an opening formed when a front cover 21 provided at the body casing 2 is swung open. The process cartridge 5 includes a drum unit 6 and a development unit 7.

The drum unit 6 principally includes a photoconductor drum 61, a charger 62, and a transfer roller 63. The development unit 7 is configured to be detachably attached to the drum unit 6. The development unit 7 principally includes a development roller 71, a supply roller 72, a doctor blade 73, and a toner reservoir 74 which is configured to store toner (developer) therein.

In the process cartridge 5, the peripheral surface of the photoconductor drum 61 is uniformly charged by the charger 62, and then exposed to a rapidly sweeping laser beam from the exposure device 4 so that an electrostatic latent image based upon image data is formed on the photoconductor drum 61. Meanwhile, toner in the toner reservoir 74 is supplied via the supply roller 72 to the development roller 71, and goes through between the development roller 71 and the doctor blade 73 so that a thin layer of toner having a predetermined thickness is carried on the development roller 71.

The toner carried on the development roller 71 is supplied to the electrostatic latent image formed on the photoconductor drum 61. Accordingly, the electrostatic latent image is visualized and a toner image is formed on the photoconductor drum 61. Thereafter, while a sheet P is conveyed through between the photoconductor drum 61 and the transfer roller 63, the toner image on the photoconductor drum 61 is transferred onto the sheet P.

The fixing device 100 is provided rearwardly of the process cartridge 5. The toner image (toner) transferred onto the sheet P is thermally fixed on the sheet P while passing through the fixing device 100. The sheet P with the toner image thermally fixed thereon is ejected by conveyor rollers 23, 24 onto a sheet output tray 22.

<Detailed Structure of Fixing Device>

Figure 2:
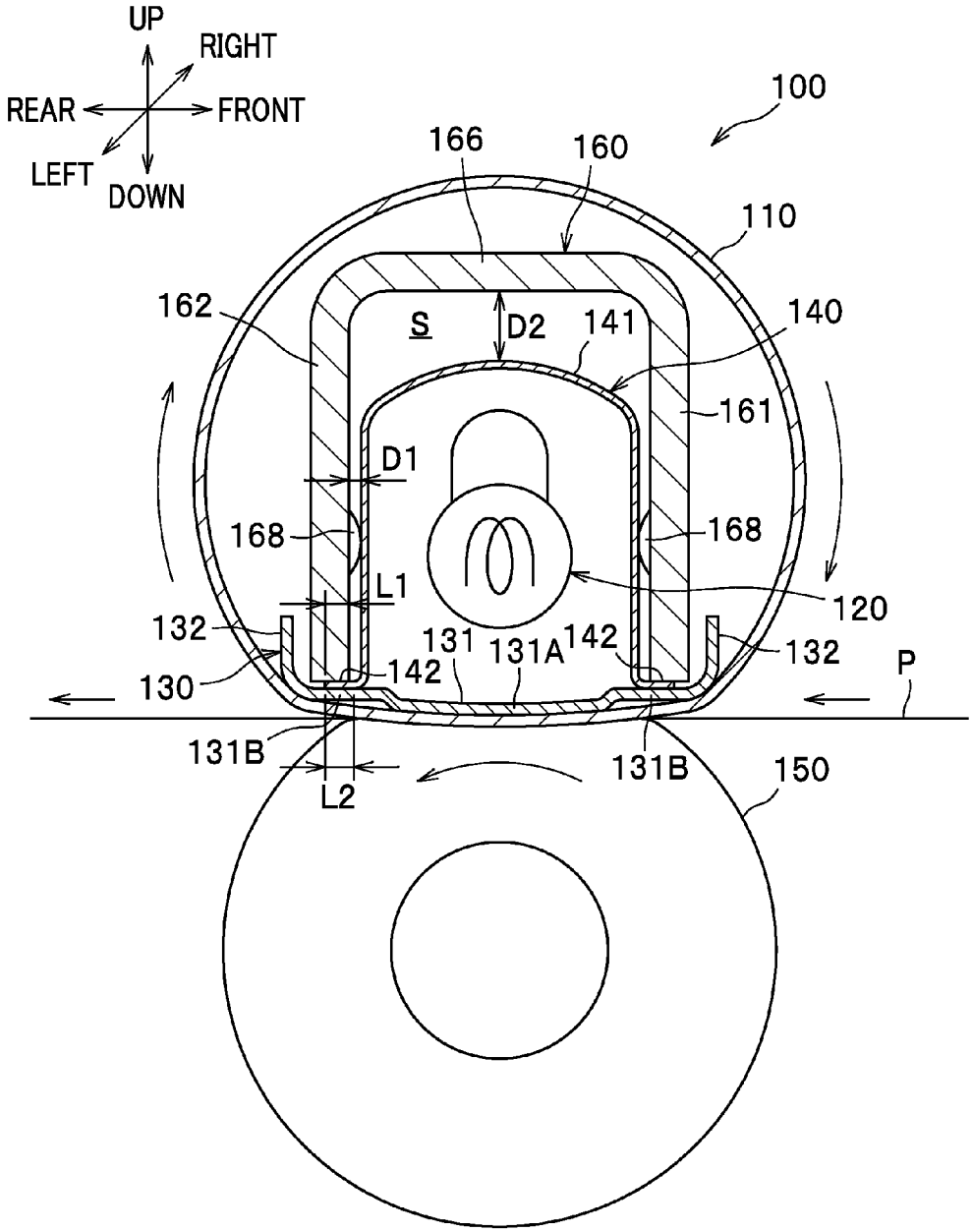
FIG. 2 is a schematic section of a fixing device according to an exemplary embodiment of the present invention.

As shown in FIG. 2, the fixing device 100 principally includes a fusing film 110 as one example of a flexible fusing member, a halogen lamp 120 as one example of a heating element, a nip plate 130 as one example of a nip member, a reflecting plate 140, a pressure roller 150 as one example of a backup member, and a stay 160.

In the following description, a conveyance direction of a sheet P (i.e., substantially front-rear direction) will be referred to simply as a "sheet conveyance direction", and a direction along a width of a sheet P as conveyed (i.e., substantially right-left direction) will be referred to simply as a "sheet width direction". Further, a pressing direction along which the pressure roller 150 applies a pressing force (i.e., substantially an upward-downward direction) will be referred to simply as a "pressing direction".

The fusing film 110 is an endless (tubular) film having thermostability and flexibility. Rotation of the fusing film 110 is guided by a guide member (not shown) provided at both right and left end portions of the fusing film 110 (i.e., at both end portions of the fusing film 110 with respect to the sheet width direction).

The halogen lamp 120 is a known heating element configured to heat the nip plate 130 and the fusing film 110 to thereby heat toner on the sheet P. For example, the halogen lamp 120 includes a glass tube, and a heating resistor disposed inside the glass tube. The halogen lamp 120 is disposed inside the fusing film 110, and spaced a predetermined distance apart from inner surfaces of the fusing film 110 and the nip plate 130.

The nip plate 130 is a plate-like member configured to receive a pressing force of the pressure roller 150 and to transmit radiant heat from the halogen lamp 120 through the fusing film 110 to the toner on the sheet P. The nip plate 130 is made from a metal plate and extends longitudinally in the axial direction of the fusing film 110. The nip plate 130 is disposed in such a manner as to contact with an inner surface of the tubular fusing film 110 and to allow the fusing film to slide along the nip plate 130.

The nip plate 130 has a thermal conductivity greater than a steel stay 160 to be described later. The nip plate 130 is formed, for example, by bending an aluminum plate or the like into a substantially U-shaped cross sectional form. To be more specific, as viewed in section, the nip plate 130 principally includes a base portion 131 and bent portions 132. The base portion 131 is disposed between the bent portions 132 and extends along the sheet conveyance direction, and the bent portions 132 extend upward at both ends of the base portion 131. The nip plate 130 is in contact with the fusing film 110 with a lubricant G (e.g., grease) applied between the nip plate 130 and the fusing film 110 so as to make the fusing film 110 smoothly slidable.

The base portion 131 includes a central portion 131A and both end portions 131B (i.e., front and rear portions in positions upstream and downstream, respectively, with respect to the sheet conveyance direction). The central portion 131A protrudes downward from the both end portions 131B toward the pressure roller 150. An inner surface (upper surface) of the base portion 131 may be painted black, or provided with a heat absorptive member. This makes the base portion 131 of the nip plate 130 more efficient in absorbing radiant heat from the halogen lamp 120.

Figure 3:
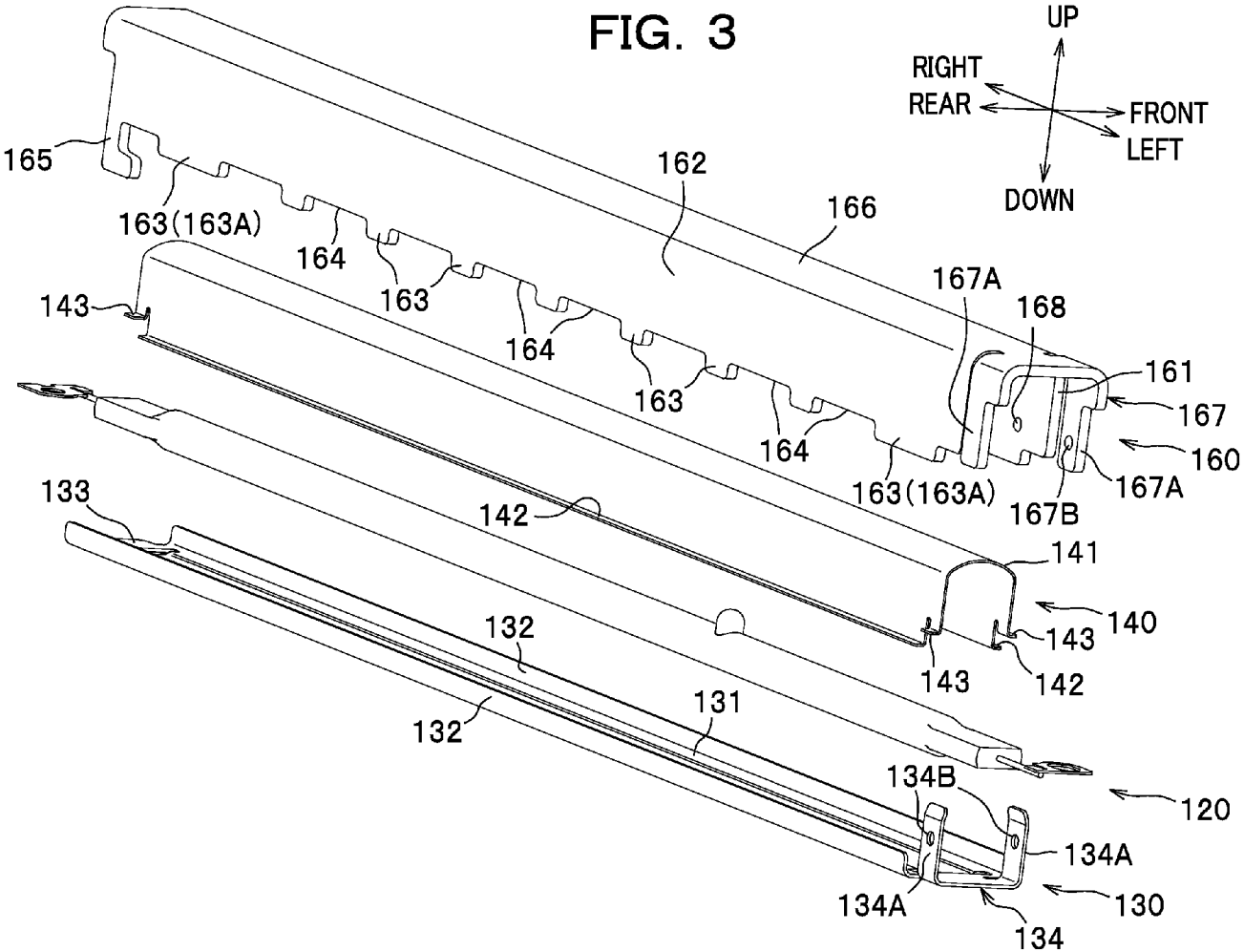
FIG. 3 is a perspective view showing a halogen lamp, a nip plate, a reflecting plate, and a stay, as disassembled.

As shown in FIG. 3, the nip plate 130 includes an insertion portion 133 extending from a right end of the base portion 131, and an engagement portion 134 formed on a left end of the base portion 131. The engagement portion 134 has a U-shaped cross section, and engageable holes 134B are provided in upwardly-bent sidewall portions 134A of the engagement portion 134.

As shown in FIG. 2, the reflecting plate 140 is a member configured to reflect radiation of heat from the halogen lamp 120 (radiant heat radiated mainly in the frontward, rearward and upward directions) toward the nip plate 130 (the inner surface of the base portion 131). The reflecting plate 140 is made from a metal plate and extends longitudinally in the axial direction of the fusing film 110, and a pair of flange portions 142 are formed by bending the metal plate substantially at right angles. The reflecting plate 140 is disposed inside the fusing film 110 to surround the halogen lamp 120, in a position spaced a predetermined distance apart from the halogen lamp 120.

The reflecting plate 140 is designed to collect radiant heat from the halogen lamp 120 to the nip plate 130, and thus the radiant heat from the halogen lamp 120 can be efficiently utilized so that the nip plate 130 and the fusing film 110 can be heated quickly.

The reflecting plate 140 is formed, for example, of an aluminum plate or the like having a high reflectance of infrared and far-infrared radiation by curving the same to have a U-shaped cross section. To be more specific, the reflecting plate 140 principally includes a reflecting portion 141 having a curved shape (i.e., substantially U-shaped cross section), and flange portions 142 extending in the sheet conveyance direction from both ends of the reflecting portion 141. In order to increase the reflectance of radiant heat, the reflecting plate 140 may be formed of a mirror-finished aluminum plate.

Figure 4:
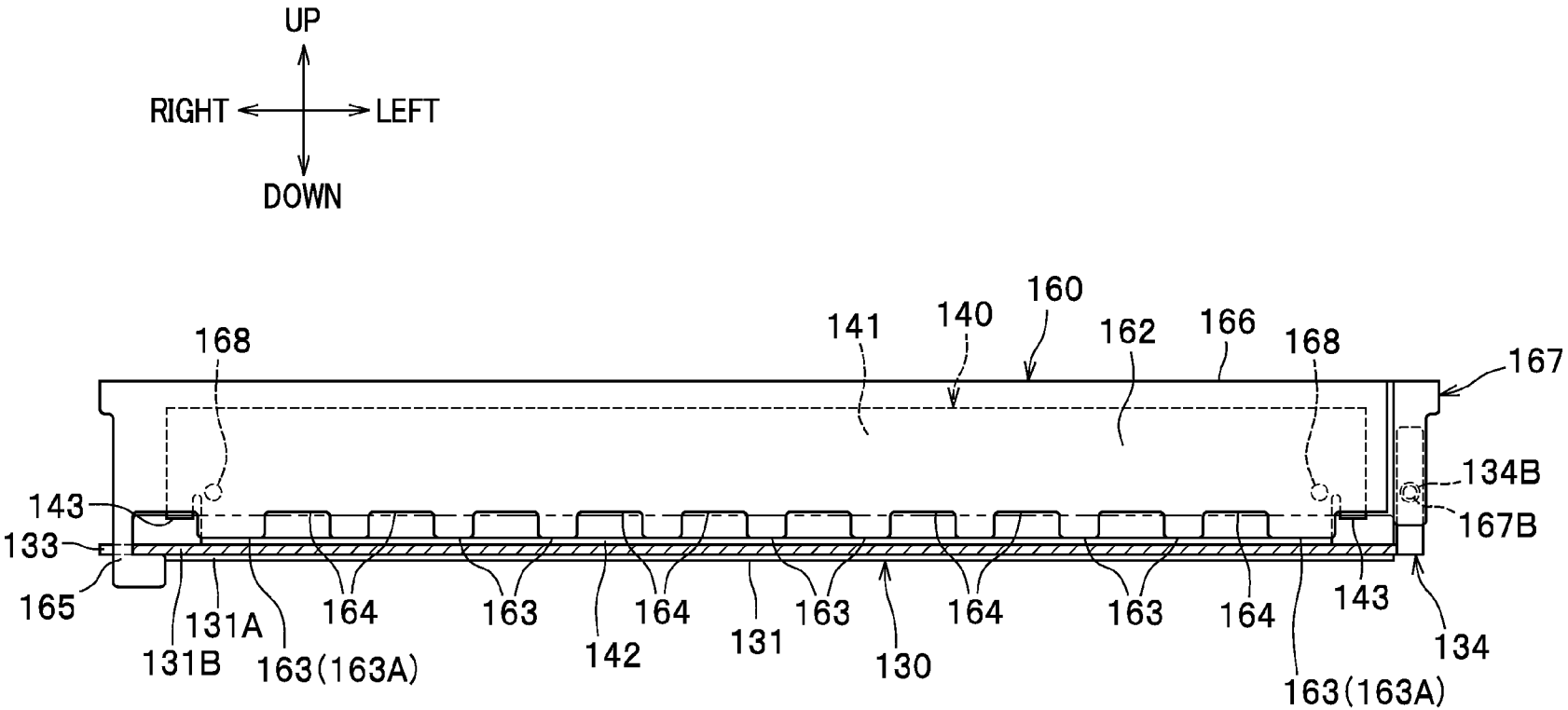
FIG. 4 is a sectional view as viewed in a recording sheet conveyance direction showing the nip plate, the reflecting plate, and the stay, as assembled.

As shown in FIG. 3, four stopper portions 143 (of which three are shown) each shaped like a flange are formed at both right and left end portions of the reflecting plate 140 with respect to the sheet width direction. The stopper portions 143 are located above the flange portions 142, and designed such that, as shown in FIG. 4, when the nip plate 130, the reflecting plate 140 and the stay 160 are assembled together, a plurality of contact portions 163 of the stay 160 which will be described later are sandwiched between the stopper portions 143 (i.e., the stopper portions come in contact with outer sides of the outermost contact portions 163A of the contact portions 163 arranged along the longitudinal direction).

With this configuration, even when the reflecting plate 140 tends to move to the left or to the right by some reason such as vibration produced during the operation of the fixing device 100, the reflecting plate 140 is restricted in its movements in the sheet width direction because the stopper portions 143 of the reflecting plate 140 come in contact with the respective contact portions 163A. As a result, an undesirable displacement of the reflecting plate 140 in the sheet width direction can be restricted effectively.

As shown in FIG. 2, the pressure roller 150 is configured such that the fusing film 110 is nipped between the pressure roller 150 and the nip plate 130 to form a nip portion between the fusing film 110 and the pressure roller 150. The pressure roller 150 is disposed below the nip plate 130. To be more specific, the pressure roller 150 is configured to press the nip plate 130 through the fusing film 110 to thereby form the nip portion between the fusing film 110 and the pressure roller 150.

The pressure roller 150 is configured to be driven to rotate by a driving force transmitted from a motor (not shown) provided in the body casing 2. Rotation of the pressure roller 150 causes the fusing film 110 to rotate, following the rotational movement of the pressure roller 150, with the help of frictional force with the fusing film 110 (or a sheet P as conveyed).

A sheet P with a toner image transferred thereon is conveyed through between the pressure roller 150 and the heated fusing film 110 (through the nip portion), so that the toner image (toner) is thermally fixed on the sheet P.

The stay 160 is configured to support the both end portions 131B of the nip plate 130 (base portion 131) located in positions upstream and downstream, respectively, with respect to the sheet conveyance direction, to thereby reinforce the nip plate 130. The stay 160 is made from a metal plate and extends longitudinally in the axial direction of the fusing film 110. The stay 160 is shaped to follow the contour of the reflecting plate 140 (reflecting portion 141) to have a substantially U-shaped cross section and provided to surround the reflecting plate 140. The stay 160 like this may be formed, for example, by bending a steel plate or the like having a relatively great rigidity into a substantially U-shaped cross sectional form. It should be noted that the thickness of the stay 160 is greater than those of the nip plate 130 and the reflecting plate 140.

A thin layer of space S is formed between the inner surface of the stay 160 and the outer surface of the reflecting plate 140 (reflecting portion 141). The space S has a dimension such that the distance D1 between the inner surface of the stay 160 (except for abutment bosses 168 to be described later) and the outer surface of the reflecting plate 140 in the sheet conveyance direction is smaller than the distance D2 between the inner surface of the stay 160 and the outer surface of the reflecting plate 140 in the pressing direction (i.e. the minimum distance in the pressing direction).

At a lower end portion of each of front and rear wall portions 161, 162 of the stay 160, as shown in FIG. 3, a plurality of contact portions 163 are provided which are shaped substantially like the teeth of a comb. The sum of the lengths of contact portions 163 in the sheet width direction is smaller than the sum of the lengths of recessed portions 164 in the sheet width direction, each of which is formed between adjacent contact portions 163.

At the right end portion of each of the front and rear wall portions 161, 162 of the stay 160, a substantially L-shaped stopper portion 165 is provided which extends downward from the lower side of the right end portion and then extends leftward. Furthermore, at the left end portion of the stay 160, a holding portion 167 is provided which is bent into a substantially U-shaped cross sectional form, having an upper wall extension portion extending leftward from an upper wall portion 166 of the stay 160 and both side wall portions 167A extending downwardly from both side edges of the upper wall extension portion. At an inner surface of each side wall portion 167A of the holding portion 167, an engageable boss 167B is provided (only one of them is illustrated) which protrudes inwardly.

As shown in FIGS. 2 and 3, on inner surfaces of the front wall portion 161 and the rear wall portion 162, the total of four abutment bosses 168 are provided in a manner protruding inwardly at the right and left end portions of the stay 160. These abutment bosses 168 abut on the reflecting plate 140 (the reflecting portion 141 thereof) from the upstream and downstream sides with respect to the sheet conveyance direction. With this configuration, even when the reflecting plate 140 tends to move to the front or to the rear by some reason such as vibration produced during the operation of the fixing device 100, the reflecting plate 140 is restricted in its movements in the sheet conveyance direction because the abutment bosses 168 come in contact with the reflecting portion 141. As a result, an undesirable displacement of the reflecting plate 140 in the sheet conveyance direction can be restricted effectively.

When the reflecting plate 140 and the nip plate 130 are assembled with the stay 160 as described above, first, the reflecting plate 140 is fitted in the stay 160. Since the abutment bosses 168 are provided on the inner surfaces of the front wall portion 161 and the rear wall portion 162 of the stay 160, the abutment bosses 168 abut on the reflecting plate 140 so that the reflecting plate 140 is provisionally held inside the stay 160.

Thereafter, as shown in FIG. 4, the insertion portion 133 of the nip plate 130 is inserted between the stopper portions 165 of the stay 160 so that the base portion 131 (both end portions 131B) engages with the stopper portions 165. Then, the engagement portion 134 (engageable holes 134B) of the nip plate 130 is engaged with the holding portion 167 (engageable bosses 167B) of the stay 160.

Accordingly, the nip plate 130 is supported on the stay 160 with the both end portions 131B of the base portion 131 being supported by the stopper portions 165 and with the engagement portion 134 being held by the holding portion 167. The reflecting plate 140 is also supported on and held inside the stay 160 with the flange portions 142 being held between the nip plate 130 and the stay 160.

Although not illustrated in the drawings, the stay 160, by which the nip plate 130 and the reflecting plate 140 are supported, and the halogen lamp 120 are held by a guide member adapted to guide the rotation of the fusing film 110. This guide member is mounted in the casing (not shown) of the fixing device 100, so that the fusing film 110, the halogen lamp 120, the nip plate 130, the reflecting plate 140 and the stay 160 are held in the casing of the fixing device 100.

In the present embodiment, as shown in FIG. 2, the reflecting plate 140 is supported with the flange portions 142 held between the nip plate 130 and the stay 160. With this configuration, even when the reflecting plate 140 tends to move upward or downward by some reason such as vibrations produced during the operation of the fixing device 100, the reflecting plate 140 is restricted in its movements in the pressing direction because the flange portions 142 are held between the nip plate 130 and the stay 160. As a result, an undesirable displacement of the reflecting plate 140 in the pressing direction can be restricted effectively so that the position of the reflecting plate 140 relative to the nip plate 130 can be fixed securely.

As viewed from side (see FIG. 2), the length L1 at which the flange portion 142 of the reflecting plate 140 and the stay 160 are in contact with each other is smaller than the length L2 at which the flange portion 142 of the reflecting plate 140 and the nip plate 130 are in contact with each other. Further, as shown in FIG. 4, the stay 160 is non-continuously in contact with the flange portions 142 at its lower surfaces of the contact portions 163 along the sheet width direction. In other words, the stay 160 is non-continuously in contact with the flange portions 142 at contacting parts (i.e., contact portions 163) and non-contacting parts (i.e., recessed portions 164). The nip plate 130 and the flange portion 142 (reflecting plate 140) are continuously in contact with each other along the sheet width direction.

As described above, the sum of the lengths of the contact portions 163 in the sheet width direction is smaller than that of the recessed portions 164 in the sheet width direction. Therefore, an area of the contacting parts (i.e., at the contact portions 163) between the reflecting plate 140 and the stay 160 is smaller than that of the non-contacting parts where the stay 160 is out of contact with the reflecting plate 140 at surfaces corresponding to the recessed portions 164.

Further, while the nip plate 130 and the reflecting plate 140 are continuously in contact with each other along the sheet width direction, the area of the contacting parts between the reflecting plate 140 and the stay 160 is smaller than that of the non-contacting parts, and further, as viewed from the sheet width direction, the length L1 at which the reflecting plate 140 and the stay 160 are in contact with each other is smaller than the distance L2 at which the reflecting plate 140 and the nip plate 130 are in contact with each other. Therefore, an area where the reflecting plate 140 and the stay 160 are in contact with each other is smaller than an area where the reflecting plate 140 and the nip plate 130 are in contact with each other.

In the present embodiment, suppose that the volume of the nip plate 130 is $V_{130}$, the volume of the reflecting plate 140 is $V_{140}$, and the volume of the stay 160 is $V_{160}$, then they satisfy the relation: $V_{160} \geqq V_{130} \geqq V_{140}$. In this way, by setting the volume $V_{160}$ of the stay 160 to be the largest, the rigidity of the stay 160 can be enhanced and therefore the nip plate 130 can be provided with a sufficient structural rigidity.

Further, by reducing the volume $V_{130}$ of the nip plate 130, the nip plate 130 can be designed to have a smaller heat capacity. Accordingly, the nip plate 130 (base portion 131) is quickly heated and thus the startup time of the fixing device 100 can be reduced. In the meantime, it is necessary that a sufficient amount (more than a certain amount) of heat be applied to toner on a sheet P while the sheet P is being moved through the fixing device 100. For this reason, in order to prevent heat from excessively flowing from the nip plate 130 toward the reflecting plate 140, it is preferable that the volume $V_{130}$ of the nip plate is equal to or greater than the volume $V_{140}$ of the reflecting plate 140.

Furthermore, by setting the volume $V_{140}$ of the reflecting plate 140 to be the smallest, an amount of heat possessed by the reflecting plate 140 can be reduced so that an amount of heat collected to the nip plate 130 can be increased accordingly. Therefore, since the nip plate 130 can be quickly heated by effectively utilizing heat, the startup time of the fixing device 100 can be reduced.

In the present embodiment, the volume of the space surrounded by the nip plate 130 and the reflecting plate 140 is greater than the volume of the space (space S) surrounded by the reflecting plate 140 and the stay 160.

Further, in the present embodiment, as viewed in the axial direction of the fusing film 110, a sectional area of the space surrounded by the nip plate 130 and the reflecting plate 140 is greater than a sectional area of the space (space S) surrounded by the reflecting plate 140 and the stay 160 (see FIG. 2).

With the configuration as described above according to the present embodiment, the following advantageous effects can be achieved.

Since the reflecting plate 140 has the flange portions 142 extending along the sheet conveyance direction and each of the flange portions 142 is held and supported between the nip plate 130 and the stay 160, the position of the reflecting plate 140 with respect to the nip plate 130, in particular the position of the reflecting plate 140 in the pressing direction, can be reliably fixed using a simple configuration.

Since the nip plate 130 (base portion 131) is supported by the stay 160 (and also by the reflecting plate 140) at its both end portions 131B in the sheet conveyance direction, the rigidity of the nip plate 130 can be ensured even if the thickness of the nip plate 130 is reduced. Therefore, by reducing the thickness of the nip plate 130, the nip plate 130 can be heated quickly and thus the startup time of the fixing device 100 can be reduced. Further, even if the thickness of the nip plate 130 is reduced, an adequate nip width and an appropriate nip pressure can be ensured, so that a toner image (toner) on the sheet P can be fused satisfactorily.

Since the stay 160 is non-continuously in contact with the flange portions 142 of the reflecting plate 140 along the sheet width direction, heat transferred to the reflecting plate 140 can be prevented from escaping toward the stay 160. This make is possible to restrict heat loss, so that the nip plate 130 can be quickly heated and the startup time of the fixing device 100 can be reduced.

Since the contacting area between the reflecting plate 140 and the stay 160 is smaller than the contacting area between the reflecting plate 140 and the nip plate 130, heat transferred to the reflecting plate 140 is prone to transfer to the nip plate 130. The same advantageous effect can be obtained by the configuration in which the nip plate 130 has a heat conductivity greater than that of the stay 160 or/and the configuration in which the area of the contacting parts between the reflecting plate 140 and the stay 160 is smaller than that of the non-contacting parts. This makes it possible to restrict heat loss, so that the nip plate 130 can be quickly heated and the startup time of the fixing device 100 can be reduced.

Since a thin layer of space S is interposed between the reflecting plate 140 and the stay 160, heat loss caused by a large amount of cold air coming from outside can be restricted. Further, air present in the thin layer of space S is less likely to leak out, so that the air is heated and serves as a heat retention layer to restrict heat from escaping from the inside to the outside of the reflecting plate 140. This makes it possible to improve the heating efficiency of the nip plate 130, so that the nip plate 130 can be quickly heated and the startup time of the fixing device 100 can be reduced.

Since the distance D1 between the reflecting plate 140 and the stay 160 in the sheet conveyance direction is smaller than the distance D2 between the reflecting plate 140 and the stay 160 in the pressing direction of the pressure roller 150, the nip plate 130 can be shortened in its length along the sheet conveyance direction while ensuring a gap (space S) in the pressing direction between the reflecting plate 140 and the stay 160. Therefore, the nip plate 130 can be designed to have a smaller heat capacity, so that the nip plate 130 can be quickly heated and the startup time of the fixing device 100 can be reduced.

Although an illustrative embodiment of the present invention has been described above, the present invention is not limited to this specific embodiment. It is to be understood that modifications and changes may be made to any of the specific configurations without departing from the scope of the present invention as claimed in the appended claims.

Figure 5:
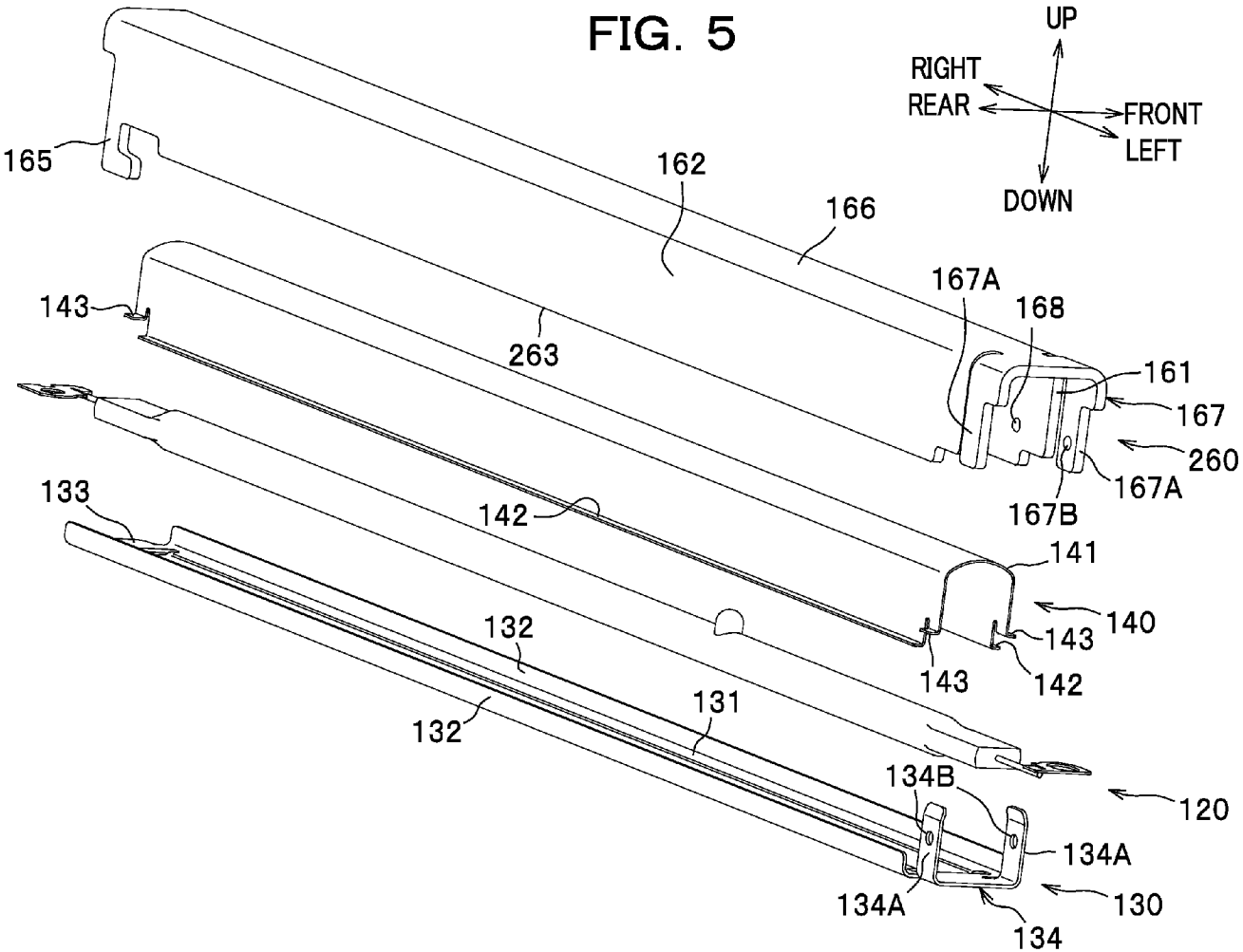
FIG. 5 is a perspective view showing the halogen lamp, the nip plate, the reflecting plate, and a stay according to a modified embodiment.

In the above-described embodiment, the stay 160 is non-continuously in contact with the flange portions 142 of the reflecting plate 140 along the sheet width direction, but the present invention is not limited to this specific configuration. For example, as shown in FIG. 5, a stay 260 may be employed, in which the entire lower surfaces (contact portions 263) of the front wall portion 161 and the rear wall portion 162 are continuously in contact with the flange portions 142 of the reflecting plate 140. With this configuration of the stay 260, air present in the space S is much less likely to leak out. Further, a force applied from the pressure roller 150 to the nip plate 130 can be stably received by the nip plate 130 through the large area of the contact portions 263. Therefore, the thickness of the nip plate 130 can be reduced further.

Figure 6:
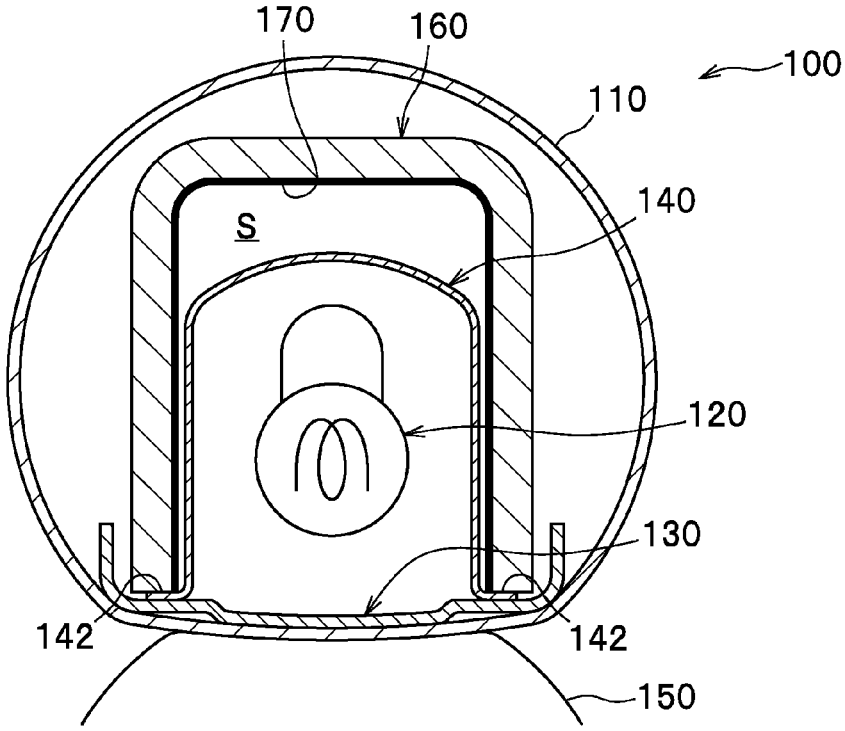
FIG. 6 is a schematic section of a fixing device according another modified embodiment, in which a heat reflecting layer is provided on the inner surface of the stay.

According to another modified embodiment of the present invention, as shown in FIG. 6, a heat reflecting layer 170 is provided on the stay 160 at the inner surface (i.e., surface facing to the reflecting plate 140) thereof. The heat reflecting layer 170 is formed, for example, by attaching an aluminum sheet on the inner surface of the stay 160. With this configuration of the heat reflecting layer 170, heat that is likely to escape from the reflecting plate 140 to the stay 160 can be reflected back toward the reflecting plate 140. This makes it possible to restrict heat loss from the reflecting plate 140 and to heat air present in the space S so as to further enhance the heat retaining effect. Accordingly, since the heat loss can be restricted as a whole, the startup time of the fixing device 100 can be reduced.

Figure 7:
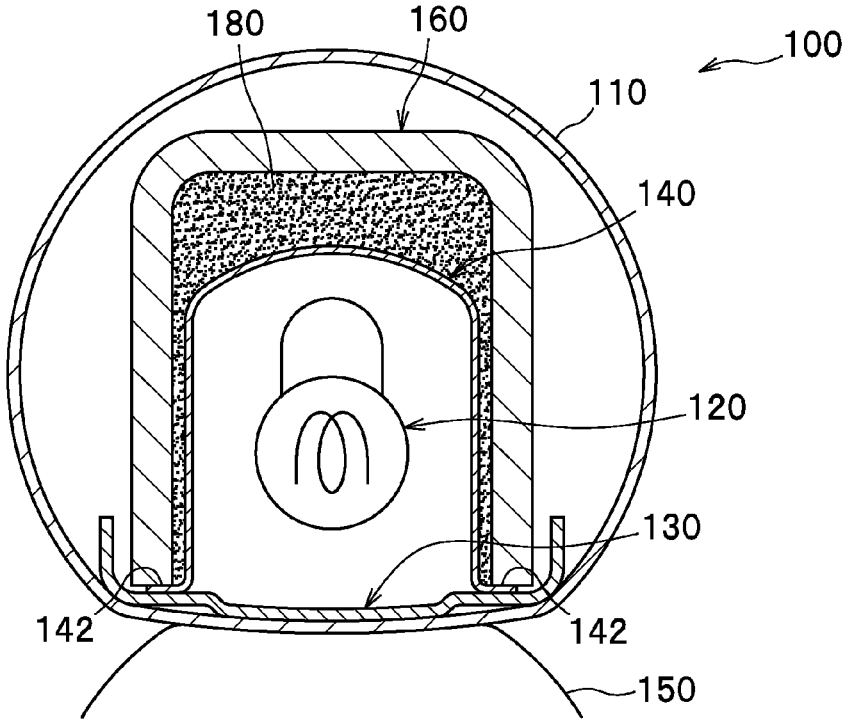
FIG. 7 is a schematic section of a fixing device according to a still another modified embodiment, in which a heat insulating layer is provided on the inner surface of the stay.

As an alternative, a heat insulator may be disposed between the reflecting plate 140 and the stay 160 (i.e., within the space S) in place of the heat reflecting layer 170. To be more specific, as shown in FIG. 7, a heat insulating layer 180 is provided on the stay 160 at the inner surface (i.e., surface facing to the reflecting plate 140) thereof, for example, by attaching a heat insulator such as made of glass wool or flame-retardant polyethylene on the inner surface of the stay 160. Such a heat insulator can also restrict heat loss, and therefore, the startup time of the fixing device 100 can be reduced.

The heat insulator may be filled between the reflecting plate 140 and the stay 160 (i.e., within the space S) as shown in FIG. 7. The heat insulator may be formed as a sheet-like member such as the heat reflecting layer 170 of FIG. 6, and attached to the inner surface of the stay 160. A sheet-like heat insulator may be held and supported between the flange portions 142 of the reflecting plate 140 and the stay 160. Further, the heat insulator may be provided between the flange portions 142 and the stay 160 as well as in the space S.

In the above-described embodiment, the distance D1 between the reflecting plate 140 and the stay 160 in the sheet conveyance direction is smaller than the distance D2 between the reflecting plate 140 and the stay 160 in the pressing direction, but the present invention is not limited to this specific configuration. For example, the distance between the reflecting plate and the stay may be substantially the same at all positions.

In the above-described embodiments, the halogen lamp 120 (halogen heater) is employed as an example of a heating element, but the heating element consistent with the present invention is not limited thereto. For example, an infrared heater or a carbon heater may be adopted, instead.

In the above-described embodiment, the central portion 131A of the nip plate 130 (base portion 131) in the sheet conveyance direction is formed by bending to have a downward protrusion extending downward from the both end portions 131B, but the present invention is not limited to this specific configuration. For example, the central portion may be formed by bending to have an upward protrusion extending upward from the both end portions. As an alternative, the nip plate 130 (base portion 131) may have a flat plate-like shape.

In the above-described embodiment, the pressure roller 150 is employed as an example of a backup member, but the backup member consistent with the present invention is not limited thereto. For example, a belt-like pressure member may be adopted, instead.

Figure 8:
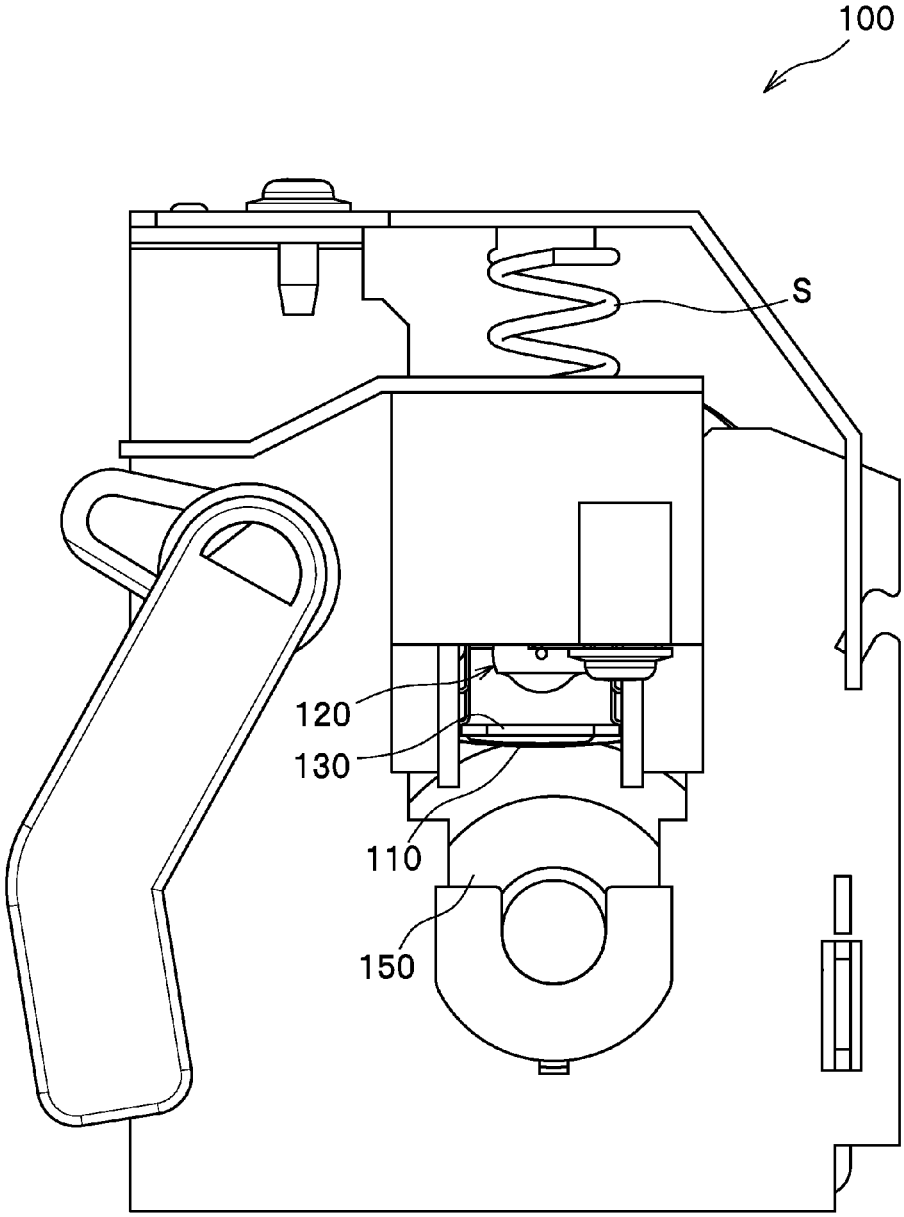
FIG. 8 is a schematic diagram of a fixing device to illustrate one example of a pressing mechanism consistent with the present invention.

Furthermore, in the above-described embodiment, the pressure roller 150 (backup member) is pressed against the nip plate 130 to form a nip portion for a sheet, but the present invention is not limited to this specific configuration. Instead, the nip portion may be formed by an alternative configuration in which the nip plate is pressed against the backup member. For example, in one embodiment, as shown in FIG. 8, the nip plate 130 (and also the stay for supporting the both end portions of the nip plate 130) may be pressed against the pressure roller 150 with the fusing film 110 nipped between the nip plate 130 and the pressure roller 150, with the help of a mechanical spring S.

The fusing film or fusing member may be a film (e.g., of resin or metal), or a film of which an outer surface is covered with a rubber layer.

Further, the nip plate consistent with the present invention may be an assembly of a nipping part (corresponding to the central portion) and structural parts adapted to be supported by a stay (corresponding to the both end portions).

In the above-described embodiment, a sheet P (e.g., of paper) is used as an example of a recording sheet, but the recording sheet consistent with the present invention is not limited thereto, and an OHP sheet or the like may be adopted.

In the above-described embodiment, the fixing device 100 is described as being included in the laser printer 1 by way of example. The present invention is however not limited to this example. Alternatively, the fixing device consistent with the present invention may be used in an LED printer in which an exposure is performed using LEDs, or used in any other known image forming apparatuses such as photocopiers, multifunction peripherals, etc. Furthermore, the above-described embodiment describes a monochrome image forming apparatus, but the present invention is not limited thereto. The image forming apparatus to which the fixing device according to the present invention is applicable may be a color image forming apparatus.

What is claimed is:

1. A fixing device for thermally fixing a developer image transferred onto a recording sheet, comprising:

a tubular fusing film;

a heating element disposed inside the fusing film;

a nip plate disposed in such a manner as to contact with an inner surface of the fusing film and to allow the fusing film to slide along the nip plate;

a reflecting plate configured to reflect radiant heat from the heating element in a direction toward the nip plate;

a backup member configured to nip the fusing film with the nip plate to thereby form a nip portion for the recording sheet between the fusing film and the backup member; and a stay configured to support both end portions of the nip plate located in positions upstream and downstream, respectively, with respect to a recording sheet conveyance direction, wherein the reflecting plate has at least one flange portion extending along the recording sheet conveyance direction, and the at least one flange portion is held and supported between the nip plate and the stay, wherein the stay is non-continuously in contact with the at least one flange portion along a recording sheet width direction, and wherein an area of contacting parts between the reflecting plate and the stay is smaller than that of non-contacting parts.

2. A fixing device according to claim 1, wherein the area of contacting parts between the reflecting plate and the stay is smaller than a contacting area between the reflecting plate and the nip plate.

3. A fixing device according to claim 1, wherein a heat insulator is provided between the reflecting plate and the stay.

4. A fixing device according to claim 1, wherein the nip plate has a heat conductivity greater than that of the stay.

5. A fixing device according to claim 1, wherein the stay is a metal plate extending longitudinally in an axial direction of the tubular fusing film, the nip plate is a metal plate extending longitudinally in the axial direction of the tubular fusing film, and the reflecting plate is a metal plate extending longitudinally in the axial direction of the tubular fusing film, and wherein a pair of flange portions are formed in the reflecting plate by bending the metal plate of the reflecting plate.

6. A fixing device according to claim 5, wherein the flange portions of the reflecting plate are formed by bending the metal plate substantially at right angles.

7. A fixing device according to claim 5, wherein a thickness of the stay is greater than those of the nip plate and the reflecting plate.

8. A fixing device according to claim 5, wherein the heating element is a heater which comprises a glass tube and a heating resistor disposed inside the glass tube.

9. A fixing device according to claim 5, wherein the reflecting plate has a first surface facing the heating element and a second surface opposite to the first surface, and wherein each of the flange portions is held and supported between the nip plate and the stay while the nip plate and the stay are in contact with the flange portions at the first surface and the second surface, respectively.

10. A fixing device for thermally fixing a developer image transferred onto a recording sheet, comprising:

a flexible fusing member which is flexibly deformable;

a heating element;

a nip member disposed in such a manner as to contact with a surface of the flexible fusing member and to allow the flexible fusing member to slide along the nip member;

a reflecting plate configured to reflect radiant heat from the heating element in a direction toward the nip member;

a backup member configured to nip the flexible fusing member with the nip member to thereby form a nip portion for the recording sheet between the flexible fusing member and the backup member; and a stay configured to support both end portions of the nip member, wherein the reflecting plate has at least one flange portion, and the at least one flange portion is held and supported between the nip member and the stay, wherein the stay is non-continuously in contact with the at least one flange portion along a recording sheet width direction, and wherein an area of contacting parts between the reflecting plate and the stay is smaller than that of non-contacting parts.

11. A fixing device according to claim 10, wherein the flexible fusing member is tubular-shaped, wherein the stay is a metal plate extending longitudinally in an axial direction of the flexible fusing member, the nip member is a metal plate extending longitudinally in the axial direction of the flexible fusing member, and the reflecting plate is a metal plate extending longitudinally in the axial direction of the flexible fusing member, and wherein a pair of flange portions are formed in the reflecting plate by bending the metal plate of the reflecting plate.

12. A fixing device according to claim 10, wherein the flange portions of the reflecting plate are formed by bending the metal plate substantially at right angles.

13. A fixing device according to claim 10, wherein the reflecting plate has a first surface facing the heating element and a second surface opposite to the first surface, and wherein each of the flange portions is held and supported between the nip member and the stay while the nip member and the stay are in contact with the flange portions at the first surface and the second surface, respectively.

* * * * *